US006883902B2

(12) United States Patent
Xin-Shan et al.

(10) Patent No.: US 6,883,902 B2
(45) Date of Patent: Apr. 26, 2005

(54) PIEZOELECTRIC LIQUID-JET HEAD HAVING A SUPERCONDUCTOR LAYER

(75) Inventors: Li Xin-Shan, Nagano-ken (JP); Tsutomu Nishiwaki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/614,700

(22) Filed: Jul. 8, 2003

(65) Prior Publication Data

US 2004/0135851 A1 Jul. 15, 2004

(30) Foreign Application Priority Data

Jul. 8, 2002 (JP) ..... 2002-199252

(51) Int. Cl.[7] ..... B41J 2/045; B41J 2/055

(52) U.S. Cl. ..... 347/70; 347/71; 310/330

(58) Field of Search ..... 257/415–417, 257/627, 628; 347/68, 71, 72; 310/324, 330, 331; 505/237, 238, 191; 428/697, 700, 701, 702, 930; 174/125.1

(56) References Cited

U.S. PATENT DOCUMENTS 6,142,615 A * 11/2000 Qiu et al. ..... 347/70
6,511,161 B1 * 1/2003 Sumi et al. ..... 347/68
6,537,689 B1 * 3/2003 Schoop et al. ..... 428/701
6,617,283 B1 * 9/2003 Paranthaman et al. ..... 505/238

FOREIGN PATENT DOCUMENTS

JP 5-286131 A 11/1993

OTHER PUBLICATIONS

"Complex Oxide Materials for Advanced Devices". Retrived from the Internet: Oct. 12, 2004. URL: http://fy.chalmers.se/supra/plans/SSFApp.pdf. p. 4.*

* cited by examiner

*Primary Examiner*—Michael S. Brooke
*Assistant Examiner*—Geoffrey Mruk
(74) *Attorney, Agent, or Firm*—Sughrue Mion, PLLC

(57) ABSTRACT

A piezoelectric liquid-jet head apparatus, which provides a nearly uniform piezoelectric element and enables ejection of liquid at maximum output, is disclosed. The piezoelectric liquid-jet head has a piezoelectric element 300 provided on one surface of a passage forming substrate 10 via a vibration plate. The piezoelectric liquid jet head includes: a zirconium oxide layer 101 formed on the surface of the passage forming substrate 10; a cerium oxide layer 102 formed on the zirconium oxide layer 101; a superconductor layer 103 formed on the cerium oxide layer 102 and composed of a yttrium-barium-copper-oxygen-based material (YBCO); a lower electrode 60 formed on the superconductor layer 103 and composed of strontium ruthenate; and a piezoelectric layer 70 which is a single crystal epitaxially grown on the lower electrode 60.

9 Claims, 10 Drawing Sheets

PIEZOELECTRIC LIQUID-JET HEAD HAVING A SUPERCONDUCTOR LAYER

BACKGROUND OF THE INVENTION

1. Field of the Invention

This invention relates to a liquid-jet head, and a liquid-jet apparatus, where a portion of a pressure generating chamber communicating with a nozzle orifice for ejecting a liquid is constituted of a vibration plate, a piezoelectric element is formed on the surface of the vibration plate, and the liquid is ejected by displacement of the piezoelectric element.

2. Description of the Prior Art

An example of a liquid-jet apparatus is an ink-jet recording apparatus having an ink-jet recording head equipped with a plurality of pressure generating chambers for generating pressure for ink droplet ejection by a piezoelectric element or a heating element; a common reservoir for supplying ink to the respective pressure generating chambers; and nozzle orifices communicating with the respective pressure generating chambers. This ink-jet recording apparatus applies ejection energy to ink within the pressure generating chamber communicating with a nozzle corresponding to a printing signal to eject ink droplets through the nozzle orifice.

Such an ink-jet recording head is roughly classified into two types. One of them is a recording head in which a heating element, such as a resistance wire, for generating Joule heat in response to a drive signal is provided within a pressure generating chamber, as stated above, and ink droplets are ejected through a nozzle orifice by bubbles produced by the heating element. The other recording head is that of a piezoelectric vibration type in which a portion of a pressure generating chamber is constituted of a vibration plate, and the vibration plate is deformed by a piezoelectric element to eject ink droplets through a nozzle orifice.

Two types of the ink-jet recording head under the piezoelectric vibration system have found practical use, namely, a recording head using a piezoelectric actuator of longitudinal vibration mode which expands and contracts the piezoelectric element in the axial direction, and a recording head using a piezoelectric actuator of flexural vibration mode.

The former recording head can change the volume of the pressure generating chamber by abutting the end surface of the piezoelectric element against the vibration plate, and enables manufacturing of a head suitable for high density printing. However, this recording head needs a difficult step of cutting and dividing the piezoelectric element in a comb tooth shape in conformity with the array pitch of the nozzle orifices, and also requires an operation for aligning and fixing the divisions of the piezoelectric element to the pressure generating chambers. Consequently, the manufacturing process is complicated.

In the latter recording head, on the other hand, the piezoelectric element can be fabricated and installed on a vibration plate by a relatively simple step of adhering a green sheet of a piezoelectric material to the shape of the pressure generating chamber, and then sintering the green sheet. However, a certain size of the vibration plate is required because of the usage of flexural vibration, thus posing difficulty in achieving a high density array of the piezoelectric elements.

To resolve the disadvantage of the latter recording head, a recording head, as shown in Japanese Unexamined Patent Publication No. 1993-286131, is proposed, in which a uniform piezoelectric material layer is formed throughout the surface of the vibration plate by a deposition technology, and the piezoelectric material layer is cut and divided into a shape corresponding to the pressure generating chamber by a lithography method, so that piezoelectric elements are formed independently of each other for the respective pressure generating chambers.

According to the above-described process, an operation for adhering the piezoelectric element onto the vibration plate is unnecessary. The advantage is also conferred that not only the piezoelectric elements can be fabricated and installed with high density by lithography, which is an accurate and simple method, but also the thickness of the piezoelectric element can be decreased to permit a high-speed drive.

The piezoelectric element is formed, for example, by stacking a lower electrode, a piezoelectric layer, and an upper electrode in this order on one surface of a single crystal silicon substrate. The piezoelectric layer is generally a polycrystalline thin film composed of lead zirconate titanate (PZT) or the like, and has a columnar growth structure where many interfaces among the crystals, namely, many grain boundaries, are present.

With the above-described ink-jet recording head, for example, a drive voltage is applied from external wiring or the like to the lower electrode and the upper electrode having the piezoelectric layer sandwiched therebetween to generate a predetermined drive electric field in the piezoelectric layer, thereby causing flexural deformation to the piezoelectric element and the vibration plate. As a result, the internal pressure of the pressure generating chamber is substantially raised to eject ink droplets from the nozzle orifice.

Such a conventional ink-jet recording head has many grain boundaries existent between the crystals of the piezoelectric layer. These grain boundaries constitute the cause of hampering the expansion and contraction of the piezoelectric layer, i.e., the expansion and contraction of the columnar crystals. Thus, the amount of displacement of the piezoelectric element cannot be set at a predetermined value. This poses the problem that ink ejection cannot be performed at maximum output, namely, with maximum amount of displacement of the piezoelectric element when a certain driving electric field is generated in the piezoelectric layer. Even when the predetermined driving electric field is generated in the piezoelectric layer, the problem arises that under the influence of the grain boundaries, the piezoelectric characteristics of the piezoelectric element substantially fluctuate.

These problems are not limited to the ink-jet recording head, but needless to say, occur similarly in other liquid-jet heads.

SUMMARY OF THE INVENTION

The present invention has been accomplished in the light of the above-mentioned circumstances. It is the object of the invention to provide a liquid-jet head and a liquid-jet apparatus capable of making the piezoelectric characteristics of a piezoelectric element nearly uniform and ejecting a liquid at maximum output.

A first aspect of the present invention for solving the above-described problems is a liquid-jet head having a passage-forming substrate in which pressure generating chambers communicating with nozzle orifices are formed; and a piezoelectric element provided on one surface of the passage-forming substrate via a vibration plate, the piezoelectric element composed of a lower electrode, a piezoelectric layer, and an upper electrode, the liquid-jet head comprising: a zirconium oxide layer formed on the one surface of the passage-forming substrate; a cerium oxide layer formed on the zirconium oxide layer; a superconductor layer formed on the cerium oxide layer and composed of a yttrium-barium-copper-oxygen-based material (YBCO); the lower electrode formed on the superconductor layer and composed of strontium ruthenate; and the piezoelectric layer formed on the lower electrode.

In the first aspect, single-crystallization of the crystal structure of the piezoelectric layer can be realized. Thus, the piezoelectric characteristics of the piezoelectric element can be rendered nearly uniform, and liquid ejection can be performed at maximum output.

A second aspect of the present invention is the liquid-jet head according to the first aspect, wherein crystal plane orientation of the lower electrode is (100)-orientation, and crystal plane orientation of the piezoelectric layer is (100)-orientation.

In the second aspect, the crystal plane orientation of the piezoelectric layer is (100)-orientation, so that the piezoelectric characteristics of the piezoelectric element can be enhanced substantially.

A third aspect of the present invention is the liquid-jet head according to the second aspect, wherein the longitudinal direction of the pressure generating chamber is identical with, or at 45° to, (100)-direction included in the crystal plane orientation (100) of the piezoelectric layer.

In the third aspect, the crystal plane orientation of the piezoelectric layer is (100)-orientation, so that the piezoelectric characteristics of the piezoelectric element can be enhanced substantially.

A fourth aspect of the present invention is the liquid-jet head according to anyone of the first to third aspects, wherein the piezoelectric layer is composed of crystals which are rhombohedral crystals.

In the fourth aspect, the crystal structure of the piezoelectric layer is a rhombohedral one as a result of deposition of the piezoelectric layer by a predetermined thin film forming step.

A fifth aspect of the present invention is the liquid-jet head according to any one of the first to fourth aspects, wherein the piezoelectric layer is composed of lead zirconate titanate (PZT).

In the fifth aspect, the piezoelectric layer having excellent piezoelectric characteristics can be formed.

A sixth aspect of the present invention is the liquid-jet head according to any one of the first to fifth aspects, wherein the piezoelectric layer is an epitaxially grown single crystal PZT thin film.

In the sixth aspect, the crystallinity of the piezoelectric layer grows to a crystal plane orientation (100), and the crystal plane orientation of the piezoelectric layer becomes (100)-orientation. Moreover, the piezoelectric layer is formed as a single crystal PZT thin film.

A seventh aspect of the present invention is the liquid-jet head according to any one of the first to sixth aspects, wherein the passage-forming substrate is a single crystal silicon substrate whose crystal plane orientation is (100).

In the seventh aspect, the respective layers, i.e. zirconium oxide layer, cerium oxide layer, superconductor layer and lower electrode, whose crystal plane orientation is (100)-orientation, can be reliably formed on the single crystal silicon substrate in crystal plane orientation (100). Thus, the crystal plane orientation of the piezoelectric layer, which is formed on the lower electrode oriented in the crystal plane orientation (100), can be made (100)-orientation.

An eighth aspect of the present invention is the liquid-jet head according to the seventh aspect, wherein the pressure generating chamber is formed in the single crystal silicon substrate by dry etching, and each layer of the piezoelectric element is formed by a deposition and lithography method.

In the eighth aspect, the pressure generating chamber and the piezoelectric element, both of predetermined shapes, can be formed reliably.

A ninth aspect of the present invention is a liquid-jet apparatus comprising the liquid-jet head according to any one of the first to eighth aspects.

In the ninth aspect, there can be provided a liquid-jet apparatus having the liquid-jet head mounted thereon that can make the piezoelectric characteristics of the piezoelectric element nearly uniform and eject a liquid at maximum output.

BRIEF DESCRIPTION OF THE DRAWINGS

For a more complete understanding of the present invention and the advantages thereof, reference is now made to the following descriptions in conjunction with the accompanying drawings.

FIG. 6A is a sectional photograph of Comparative Example 1; and FIG. 6B is a sectional photograph of Example 1.

FIG. 8A shows an image of a rhombohedral sample of the piezoelectric layer oriented in a crystal plane orientation (100); FIG. 8B shows an image of a sample of the piezoelectric layer oriented in a crystal plane orientation (100) on a lower electrode film; and FIG. 8C shows an image of the piezoelectric element of Example 1.

DESCRIPTION OF THE PREFERRED EMBODIMENTS

The present invention will now be described in detail based on the embodiments offered below.

Embodiment 1

Figure 1:
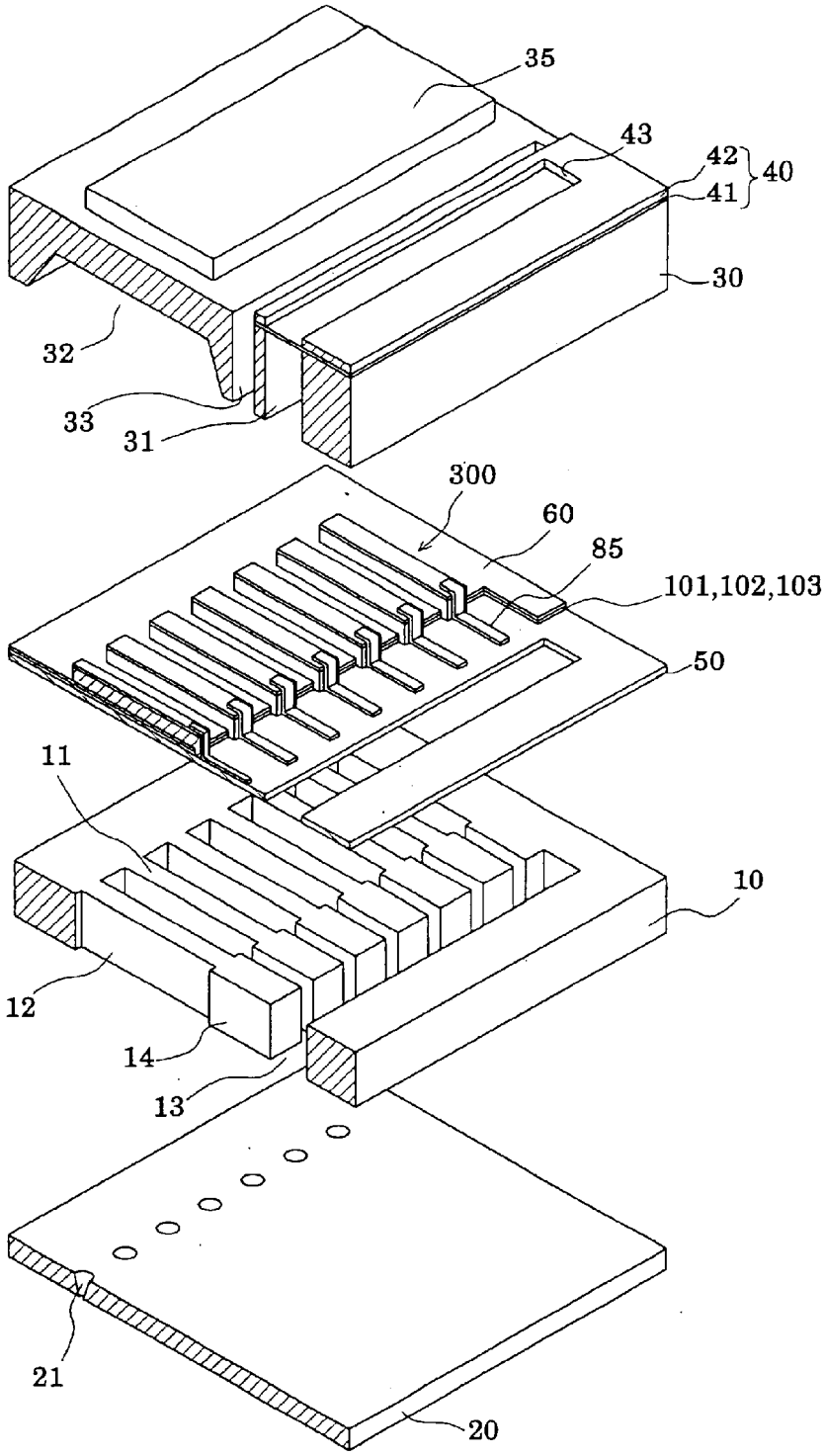
FIG. 1 is an exploded perspective view of the liquid-jet head according to embodiment 1 of the present invention.
Figure 2A:
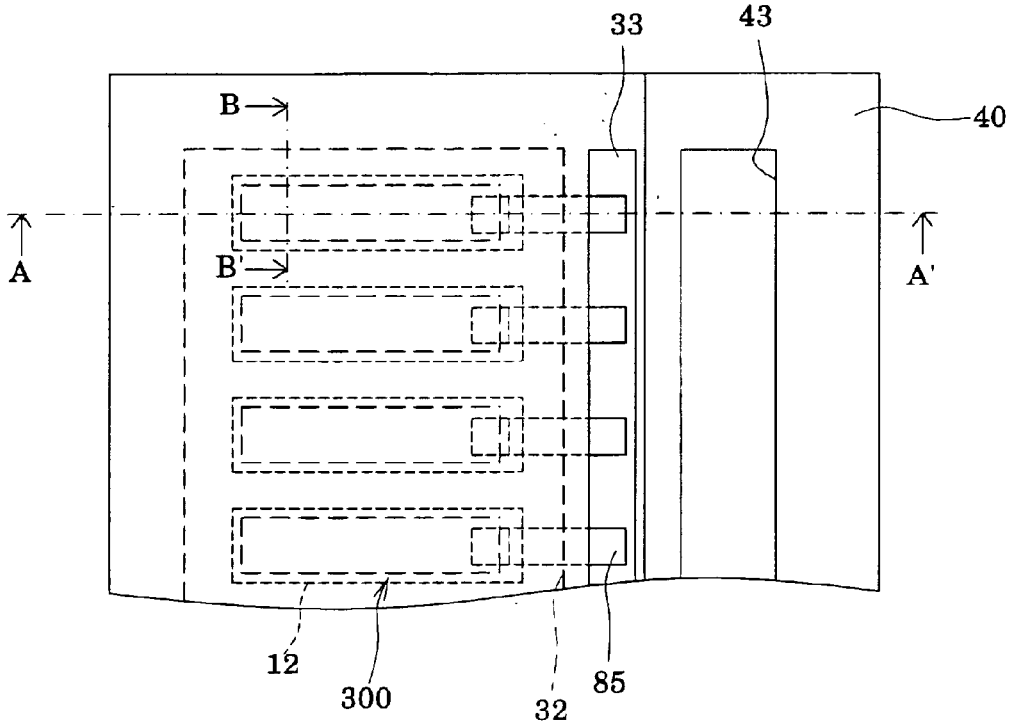
FIGS. 2A and 2B are, respectively, a plan view of the liquid-jet head according to embodiment 1 of the present invention, and a sectional view taken on line A–A' of FIG. 2A.
Figure 2B:
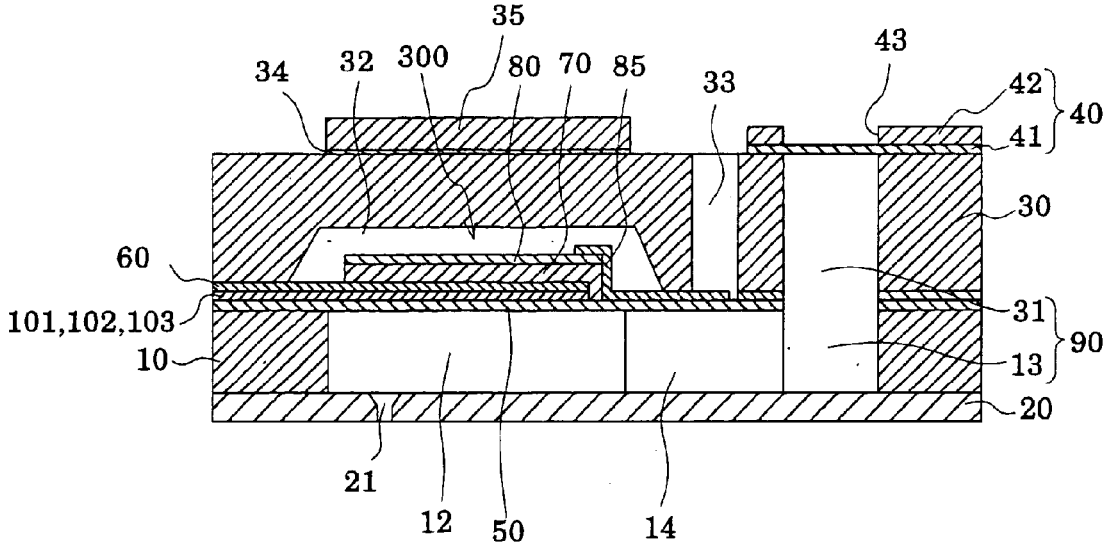
Figure 3:
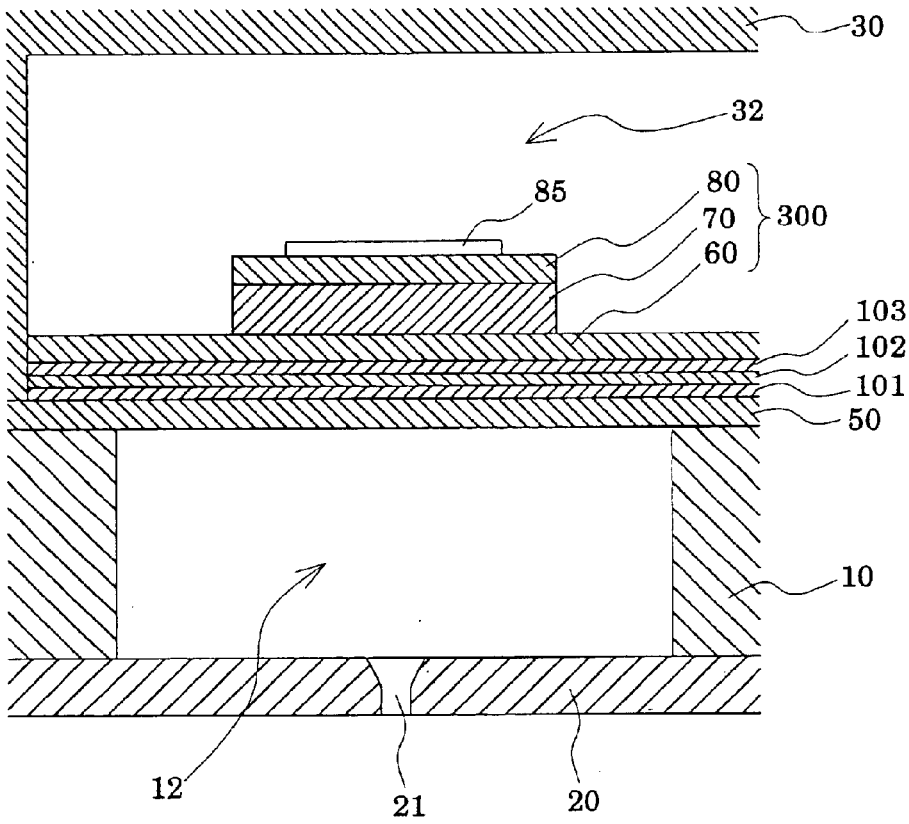
FIG. 3 is a sectional view taken on line B–B' of FIG. 2A according to embodiment 1 of the present invention.

FIG. 1 is an exploded perspective view showing an outline of the liquid-jet head according to embodiment 1 of the present invention. FIGS. 2A and 2B are, respectively, a plan view of FIG. 1, and a sectional view taken on line A–A' of FIG. 2A. FIG. 3 is a sectional view taken on line B–B' of FIG. 2A.

As shown in the drawings, a passage-forming substrate 10, in the present embodiment, consists of a single crystal silicon substrate having a crystal plane orientation (100). A 1 to 2 $\mu$m thick elastic film 50, composed of silicon oxide ($SiO_2$) formed beforehand by thermal oxidation, is formed on one surface of the passage-forming substrate 10.

In the passage-forming substrate 10, pressure generating chambers 12 divided by a plurality of compartment walls 11 are parallelly provided widthwise by dry etching performed from the one surface of the single crystal silicon substrate. The longitudinal direction of the pressure generating chamber 12 is preferably either the same direction as, or a direction at 45° to, the (100)-direction included in the crystal plane orientation (100) of a piezoelectric layer (to be described later on). In the present embodiment, the direction of the pressure generating chamber 12 is identical with the (100)-direction of the piezoelectric layer.

Longitudinally outwardly of the pressure generating chamber 12, a communicating portion 13 to be brought into communication with a reservoir portion 31 of a sealing plate 30 (to be described later on) is formed. The communicating portion 13 is in communication with one end portion in the longitudinal direction of each pressure generating chamber 12 via a liquid supply path 14. The width of the liquid supply path 14 is smaller than the width of the pressure generating chamber 12.

The thickness of the passage-forming substrate 10, where the pressure generating chambers 12, etc. are formed, is preferably an optimal thickness selected in conformity with the density of the pressure generating chambers 12 to be disposed. If about 180 of the pressure generating chambers 12 per inch (i.e. 180 dpi) are to be arranged, for example, the thickness of the passage-forming substrate 10 is preferably about 180 to 280 $\mu$m, more preferably about 220 $\mu$m. If the pressure generating chambers 12 are to be arranged at a relatively high density of about 360 dpi, for example, the preferred thickness of the passage-forming substrate 10 is 100 $\mu$m or less. This thickness would be able to increase the array density of the pressure generating chambers 12 while retaining the rigidity of the compartment wall 11 between the adjacent pressure generating chambers 12.

On the opening surface of the passage-forming substrate 10, a nozzle plate 20 having nozzle orifices 21 bored therein is fixed via an adhesive agent or a heat sealing film. The nozzle orifices 21 communicate with the pressure generating chambers 12 on the side opposite to the liquid supply paths 14.

On the elastic film 50 on the side opposite to the opening surface of the passage-forming substrate 10, a zirconium oxide layer 101, a cerium oxide layer 102, and a superconductor layer 103 are sequentially formed in a laminated form, as shown in FIG. 3, and the total thickness of these three layers is, for example, about 10 nm.

The zirconium oxide layer 101 is a thin film having a fluorite ($CF_3$) structure and epitaxially grown on the elastic film 50. The crystallinity of the zirconium oxide layer 101 is such that its crystals have the same orientation as that of the passage-forming substrate 10, that is, the crystal plane orientation of the crystals is (100)-orientation. Examples of the material forming the zirconium oxide layer 101 are yttria stabilized zirconia (YSZ) and zirconia ($ZrO_2$). In the present embodiment, YSZ is used.

The cerium oxide layer 102, like the zirconium oxide layer 101, is a thin film having a fluorite ($CF_3$) structure and epitaxially grown on the zirconium oxide layer 101. The crystallinity of the cerium oxide layer 102, like the zirconium oxide layer 101, is also such that its crystals have the same orientation as that of the zirconium oxide layer 101 as the undercoat, that is, the crystal plane orientation of the crystals is (100)-orientation.

The superconductor layer 103 is a thin film having a crystal structure similar to a perovskite structure and epitaxially grown on the cerium oxide layer 102. The crystallinity of the superconductor layer 103, like the cerium oxide layer 102, is also such that its crystals have the same orientation as that of the cerium oxide layer 102 as the undercoat, that is, the crystal plane orientation of the crystals is (100)-orientation. The material forming the superconductor layer 103 is a yttrium-barium-copper-oxygen-based material (YBCO). Its example is a compound oxide composed of yttrium oxide ($Y_2O_3$), barium oxide (BaO), and copper oxide(II) (CuO).

On the superconductor layer 103 having the crystal plane orientation (100), a lower electrode film 60 with a thickness, for example, of about 100 nm, a piezoelectric layer 70 with a thickness, for example, of about 0.2 to 5 $\mu$m, and an upper electrode film 80 with a thickness, for example, of about 50 to 100 nm are sequentially formed in a laminated state to constitute a piezoelectric element 300. Herein, the piezoelectric element 300 indicates a portion which includes the lower electrode film 60, the piezoelectric layer 70, and the upper electrode film 80. Generally, the piezoelectric element 300 is constituted such that any one of the electrodes of the piezoelectric element 300 is used as a common electrode, while the other electrode and the piezoelectric layer 70 are patterned for each pressure generating chamber 12. In this case, a portion, which is composed of any one of the electrodes and piezoelectric layer 70 that have been patterned, and where a piezoelectric distortion is generated by application of a voltage to both electrodes, is referred to as a piezoelectric active portion. In the present embodiment, the lower electrode film 60 is used as a common electrode of the piezoelectric element 300, and the upper electrode film 80 is used as an individual electrode. However, there is no problem in reversing this usage for the convenience of a drive circuit or wiring. In any case, the piezoelectric active portion is formed for each pressure generating chamber. Herein, the piezoelectric element 300 and a vibration plate, where displacement occurs by a drive of the piezoelectric element 300, are referred to as a piezoelectric actuator in combination. In the present embodiment, the vibration plate is constituted of the elastic film 50, the lower electrode film 60, the zirconium oxide layer 101, the cerium oxide layer 102 and the superconductor layer 103.

A lead electrode 85 consisting of, say, gold (Au) is connected to the upper electrode film 80 of each piezoelectric element 300. This lead electrode 85 is electrically connected to a drive IC (to be described later on).

In the present embodiment, the lower electrode film 60 as the undercoat for the piezoelectric layer 70 is a thin film epitaxially grown on the superconductor layer 103, as are the aforementioned three layers, i.e. zirconium oxide layer 101, cerium oxide layer 102 and superconductor layer 103. The lower electrode film 60 shows the same orientation as that of the superconductor layer 103 as the undercoat; namely, the lower electrode film 60 is oriented in the crystal plane orientation (100) Such a lower electrode film 60, in the present embodiment, is an oxide conductor composed of strontium ruthenate ($SrRuO_3$), and has a perovskite structure.

The piezoelectric layer 70 formed on the lower electrode film 60 is a thin film having a perovskite structure and epitaxially grown on the lower electrode film 60 as the undercoat. The crystallinity of the piezoelectric layer 70 is such that its crystals have the same orientation as that of the lower electrode film 60 as the undercoat, that is, the crystal plane orientation of the crystals is (100)-orientation.

The (100)-direction included in the crystal plane orientation (100) of the piezoelectric layer 70 is preferably either the same direction as, or a direction at 45° to, the longitudinal direction of the pressure generating chamber 12 described earlier. In the present embodiment, the (100)-direction of the piezoelectric layer 70 is identical with the longitudinal direction of the pressure generating chamber 12. Because of this feature, the piezoelectric characteristics of the piezoelectric layer 70 can be enhanced. The material for forming the piezoelectric layer 70 is, in the present embodiment, a ferroelectric material composed of lead zirconate titanate ($Pb(Zr,Ti)O_3$; PZT). Hence, the piezoelectric layer 70 is a single crystal PZT thin film having the crystal plane orientation in (100).

The piezoelectric layer 70 is formed, for example, by a so-called sol-gel method, in which a so-called sol obtained by dissolving/dispersing a metal organic material into a catalyst is coated and dried in a gel state, and then is sintered at a high temperature. Concretely, the piezoelectric layer 70, having crystals grown with the same orientation as the crystal plane orientation of the lower electrode film 60 is formed. Needless to say, the deposition method for the piezoelectric layer 70 is not limited. For example, the piezoelectric layer 70 may be formed by sputtering, the MOD method or the like.

For epitaxial growth of the piezoelectric layer 70, etc. in the same orientation as the undercoat, as in the present embodiment, it is preferred, for example, to form this layer under predetermined conditions so that the layer will have a crystal structure and spacing of lattice planes similar to those of the undercoat. It is also preferred to form the piezoelectric layer 70, etc. so as to have a crystal structure free from a repulsive force due to an electrostatic interaction with the surface of the undercoat. In the present embodiment, the aforementioned perovskite structure and fluorite structure are structurally similar, so that the respective layers, including the piezoelectric layer 70, etc. can be epitaxially grown.

In any case, the piezoelectric layer 70 deposited as described above, unlike bulk piezoelectric, has its crystals in the preferred orientation. As stated earlier, moreover, the piezoelectric layer 70 has its crystals formed as rhombohedral crystals. Note that the preferred orientation means a state where the orientation direction of crystals is not in disorder, but a specific crystal surface faces substantially in the same direction.

In the present embodiment, as described above, the zirconium oxide layer 101, cerium oxide layer 102 and superconductor layer 103 are epitaxially grown in this order on the elastic film 50 (passage-forming substrate 10). Thus, the crystal plane orientation of the lower electrode film 60 can be brought into (100)-orientation.

In the present embodiment, as noted above, the crystal plane orientation of the lower electrode film 60 can be brought into (100)-orientation. Thus, the crystal plane orientation of the piezoelectric layer 70 can also be brought into (100)-orientation.

In the present embodiment, as in the foregoing, the piezoelectric layer 70 has a single crystal structure whose crystal plane orientation is (100), and there are substantially no grain boundaries in the crystal structure. Thus, the grain boundaries do not adversely affect displacement of the piezoelectric element 300, and can gene-rate a predetermined driving electric field in the piezoelectric layer 70, thereby performing predetermined displacement of the piezoelectric element 300. Hence, the amount of displacement of the piezoelectric element 300 can be set at a predetermined value, and the piezoelectric characteristics of the piezoelectric element 300 can be rendered nearly uniform. Moreover, liquid ejection can be carried out at substantially maximum output.

Samples of Example 1 and Comparative Example 1 to be described below were prepared, and their X-ray diffraction (XRD) analyses were made. For the sample of Example 1, the crystal structure of the piezoelectric layer was analyzed by X-ray pole measurement, scanning electron microscopic (SEM) photograph observation, and transmission electron microscopic (TEM) photograph observation. The results will be described in detail with reference to FIGS. 4 to 9.

Figure 4:
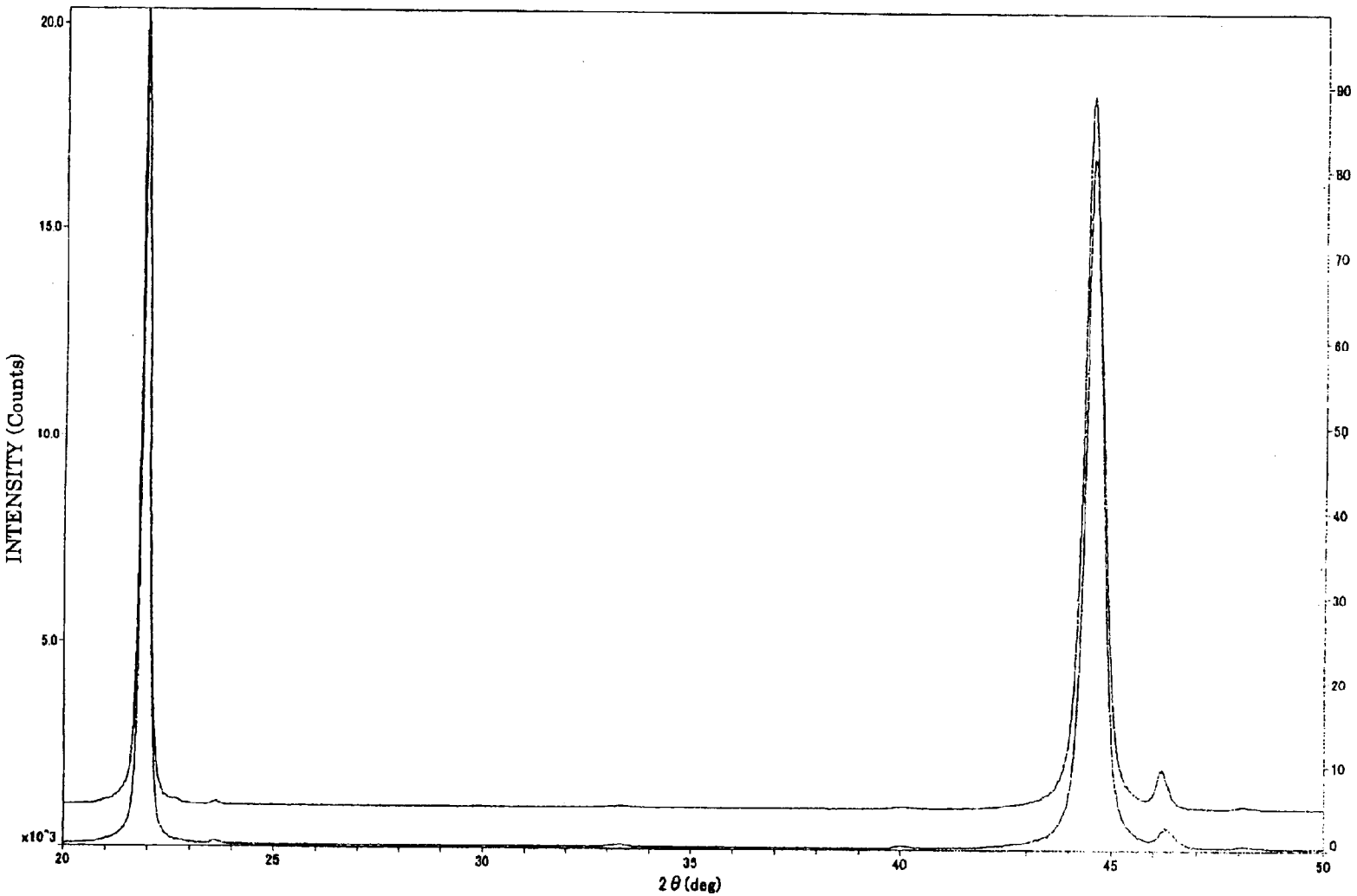
FIG. 4 is a view showing the X-ray diffraction pattern of the piezoelectric layer of Example 1 according to embodiment 1 of the present invention.
Figure 5:
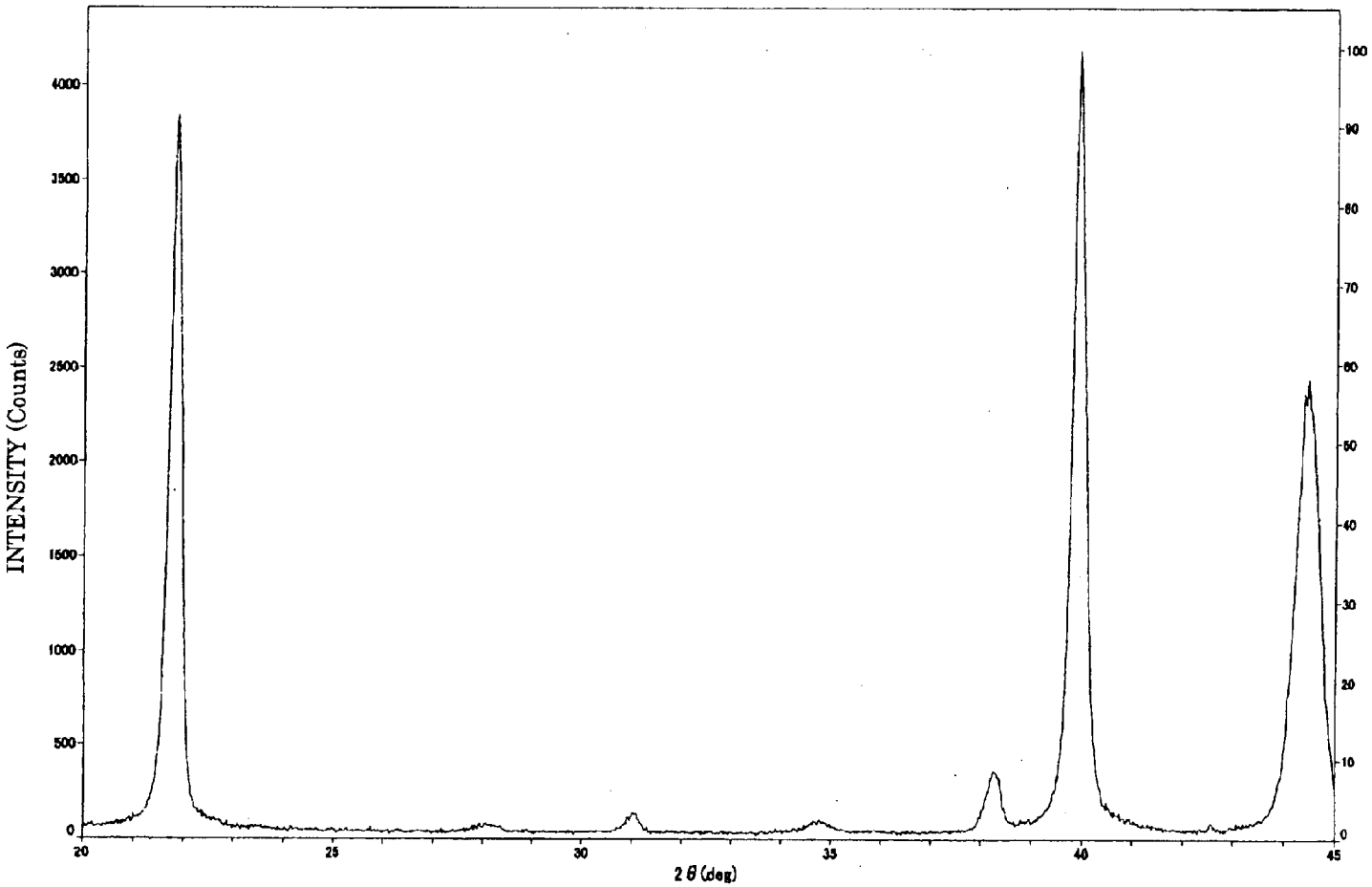
FIG. 5 is a view showing the X-ray diffraction pattern of the piezoelectric layer of Comparative Example 1 which was used as a control when the sample of Example 1 according to embodiment 1 of the present invention was subjected to analysis of the crystal structure.
Figure 6A:
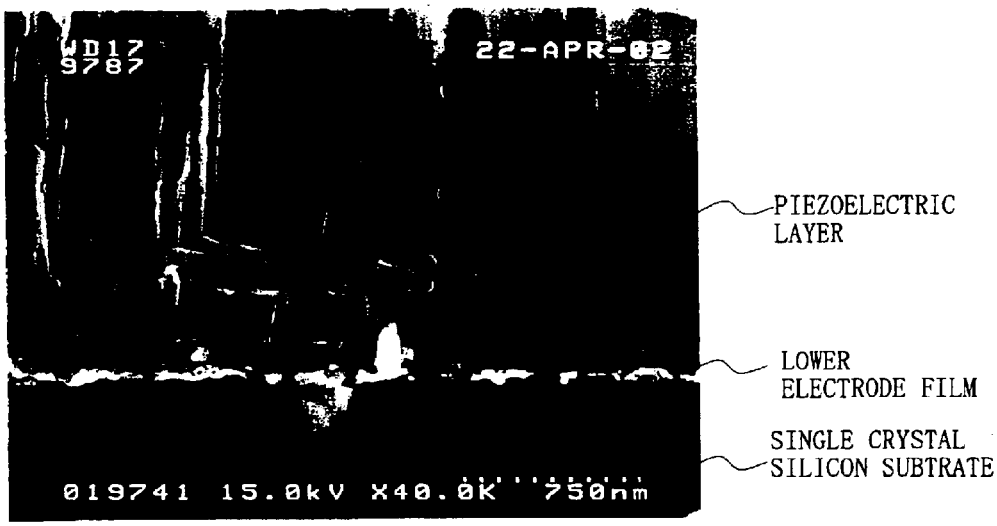
FIGS. 6A and 6B are views showing photographs by scanning electron microscopy (SEM) of the sample of the Example according to embodiment 1 of the present invention and the sample of the Comparative Example.
Figure 6B:
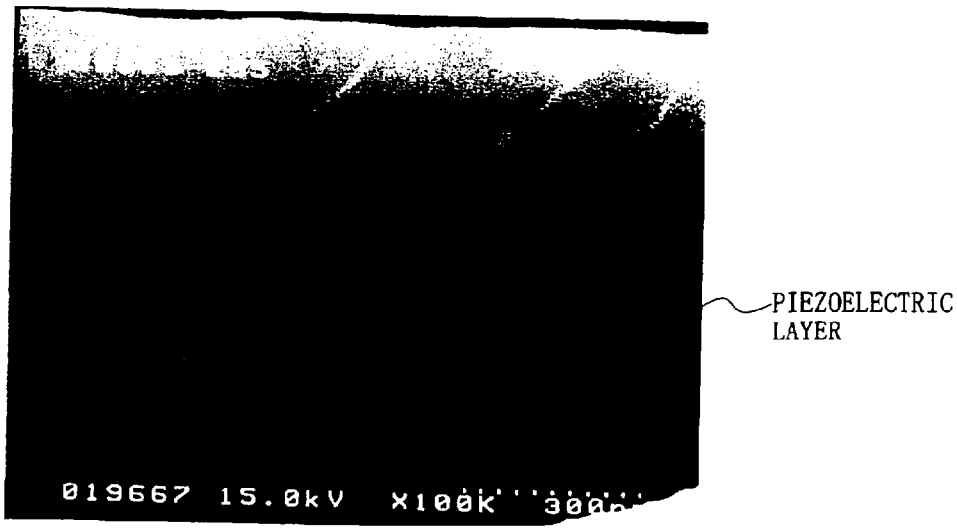
Figure 7:
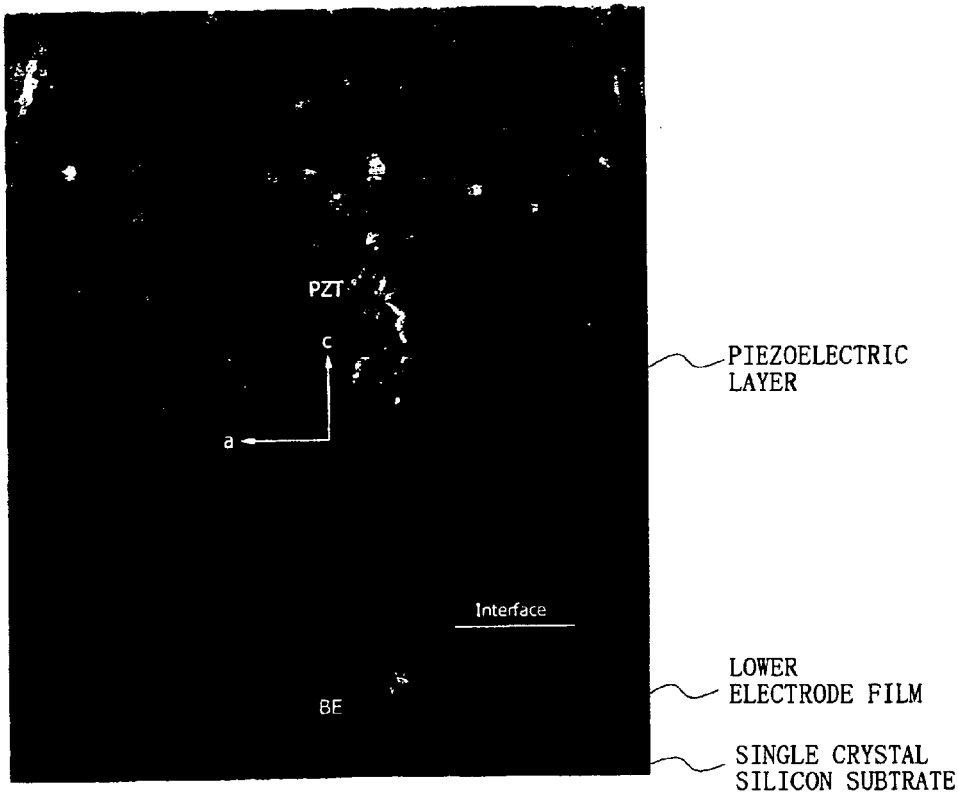
FIG. 7 is a photograph by transmission electron microscopy (TEM) of a section of the sample of Example 1 according to embodiment 1 of the present invention.
Figure 8A:
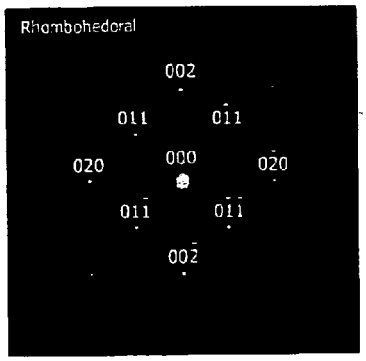
FIGS. 8A to 8C show electron diffraction images according to embodiment 1 of the present invention.
Figure 8B:
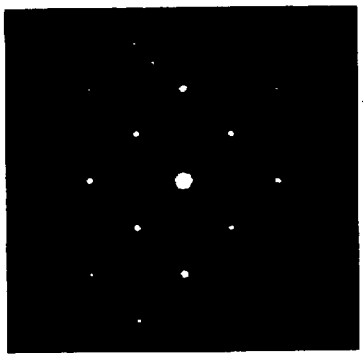
Figure 8C:
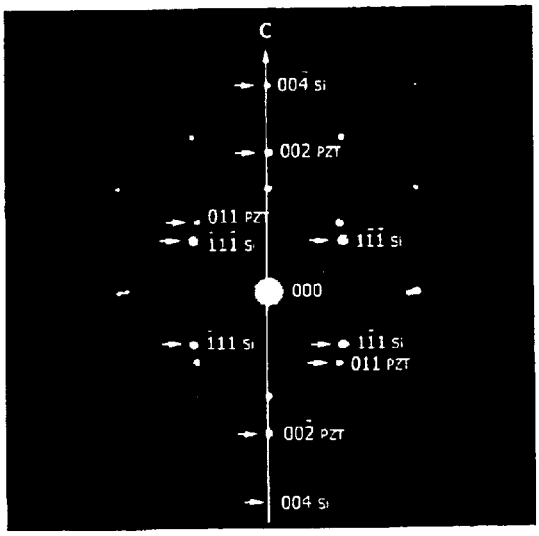
Figure 9:
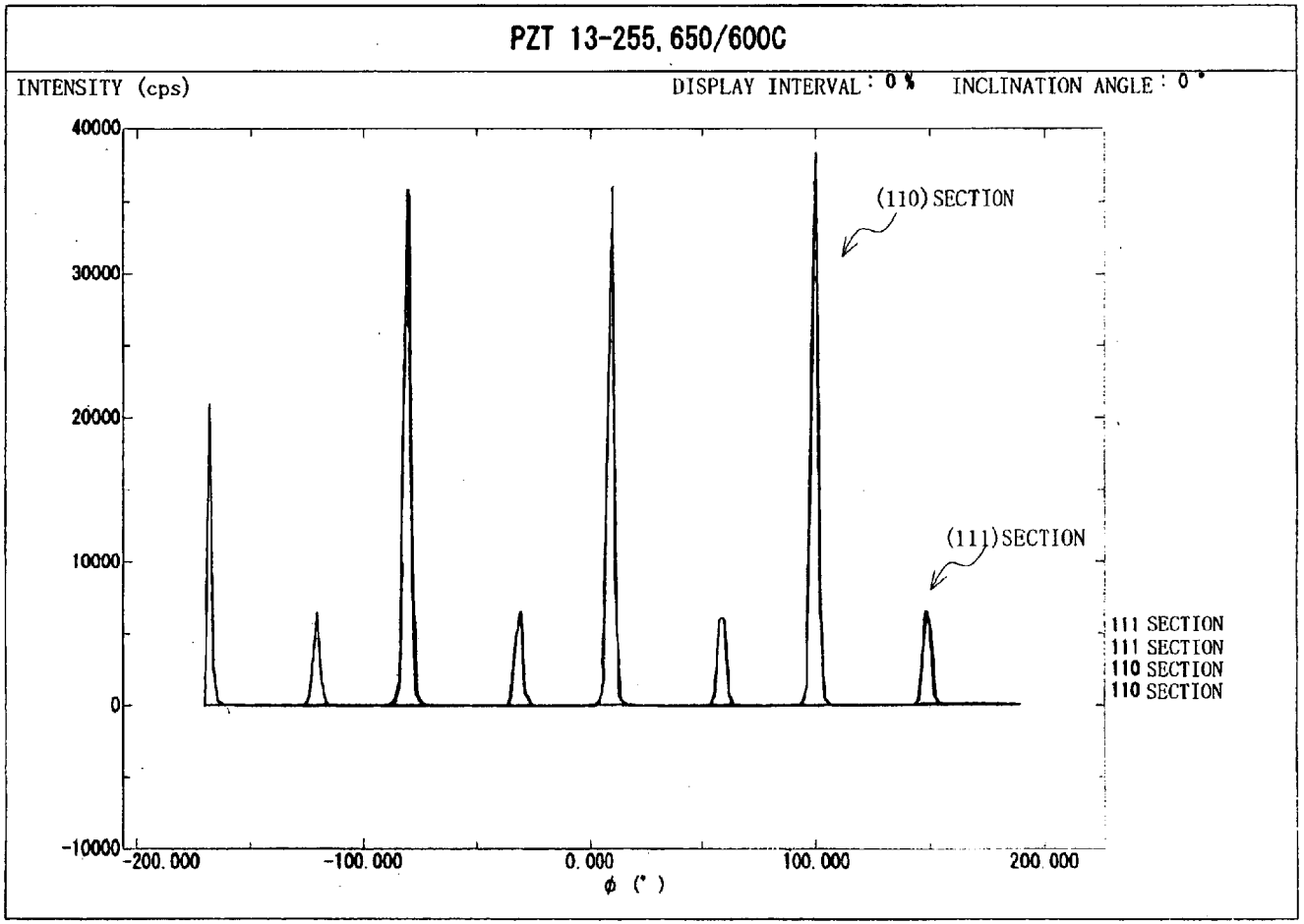
FIG. 9 shows an X-ray pole measurement pattern of the piezoelectric layer of Example 1 according to embodiment 1 of the present invention.

FIG. 4 is a view showing the X-ray diffraction pattern of the sample of the Example. FIG. 5 is a view showing the X-ray diffraction pattern of the piezoelectric layer of the Comparative Example which was used as a control when the sample of the Example was subjected to analysis of the crystal structure. FIGS. 6A and 6B are views showing SEM photographs of the samples of the Example and the Comparative Example, FIG. 6A being a sectional photograph of the Comparative Example, and FIG. 6B being a sectional photograph of the Example. FIG. 7 is a TEM photograph of a section of the sample of the Example. FIGS. 8A to 8C show electron diffraction images, in which FIG. 8A shows an image of a rhombohedral sample of the piezoelectric layer oriented in a crystal plane orientation (100), FIG. 8B shows an image of a sample of the piezoelectric layer oriented in a crystal plane orientation (100) on a lower electrode film, and FIG. 8C shows an image of the piezoelectric element of the Example. FIG. 9 shows an X-ray pole measurement pattern of the piezoelectric layer of the Example.

EXAMPLE 1

A zirconium oxide layer composed of yttria stabilized zirconia (YSZ), a cerium oxide layer composed of cerium dioxide ($CeO_2$), a superconductor layer composed of yttrium-barium-copper-oxygen-based material (YBCO) and a lower electrode film composed of strontium ruthenate ($SrRuO_3$) were sequentially stacked on a single crystal silicon substrate by PLD (pulsed laser deposition). On the lower electrode film, a piezoelectric layer composed of lead zirconate titanate (PZT) was deposited by the sol-gel method to prepare a sample for crystal structure analysis in Example 1. The PZT composition of the piezoelectric layer was $Pb_{1.16}Zr_{0.556}Ti_{0.444}O_3$.

The conditions for film deposition were drying (180° C., 10 min) and degreasing (385° C., 10 min), which were common to the respective layers. Burning subsequent to degreasing was performed under the conditions, 650° C. and 30 min, for the first layer and the second layer. For the other layers (the third and succeeding layers), the conditions, 600° C. and 30 min, were employed.

COMPARATIVE EXAMPLE 1

As a control for use in the crystal structure analysis in Example 1, a lower electrode composed of platinum (Pt) and a piezoelectric layer composed of lead zirconate titanate (PZT) were sequentially stacked on a single crystal silicon substrate to prepare a sample for crystal structure analysis in Comparative Example 1.

A detailed explanation will be offered below for the crystal structure analysis of the sample of Example 1, especially the crystal structure analysis of its piezoelectric layer.

In the crystal structure analysis based on the X-ray diffraction pattern, the samples of Example 1 and Comparative Example 1 were irradiated with X-rays of a wavelength of the order of the atomic/molecular array spacing. The arrays of the atoms and molecules of the sample were examined from a diffraction pattern produced when the X-rays reflected from the atoms and molecules interfered with each other. Based on these arrays, the orientations of the crystals of Example 1 and Comparative Example 1 were analyzed.

In the piezoelectric layer of Example 1, as shown in FIG. 4, a peak of strong intensity C representing a crystal plane orientation (100) was detected around 22 [deg]. Also, a peak of strong intensity C representing a crystal plane orientation (200) was detected around 45 [deg]. These findings show that the piezoelectric layer of Example 1 has a crystal structure oriented in the crystal plane orientation (100).

In the piezoelectric layer of Comparative Example 1, on the other hand, a peak of strong intensity C representing a crystal plane orientation (100) was detected around 22 [deg], as shown in FIG. 5. However, a peak representing a crystal plane orientation (110) was detected around 31 [deg], and a peak representing a crystal plane orientation (111) was detected around 38 [deg]. Further, a peak of strong intensity C representing a crystal plane orientation (111), which suggested a platinum layer (Pt), was detected around 40 [deg]. Besides, a peak of strong intensity C representing a crystal plane orientation (200) was detected around 45 [deg]. These findings demonstrate that the piezoelectric layer of Comparative Example 1, according to the crystal structure analysis of the X-ray diffraction pattern, has a polycrystalline structure composed of crystals oriented in a mixture of crystal plane orientations (100), (110) and (111).

In the piezoelectric layer of Example 1 in FIG. 4, by contrast, no peaks were detected around 31 and 38 [deg]. This also makes it clear that the piezoelectric layer of Example 1 is oriented solely in the crystal plane orientation (100).

Then, the crystal structures of the samples of Example 1 and Comparative Example 1 were analyzed by observing their scanning electron microscopic (SEM) photographs. Also, the crystal structure of the sample of Example 1 was analyzed by observing its transmission electron microscopic (TEM) photograph.

From the SEM photograph in FIG. 6A, many columnar crystals extending upwardly in the drawing can be confirmed on the lower electrode film. This finding shows that the piezoelectric layer of Comparative Example 1 has a columnar crystal structure. On the other hand, the SEM photograph of Example 1 in FIG. 6B cannot confirm the presence of columnar crystals on the lower electrode film.

From the TEM photograph in FIG. 7, it is clear that no grain boundaries are present in the piezoelectric layer of Example 1.

The foregoing structural analyses based on the SEM and TEM photographs indicate that the piezoelectric layer of Example 1 has a single crystal structure.

As mentioned above, the SEM photograph in FIG. 6 and the TEM photograph in FIG. 7, used in the crystal structure analysis of Example 1, pose difficulty in confirming the zirconium oxide layer, cerium oxide layer and superconductor layer existent between the single crystal silicon substrate and the lower electrode film. This is because the total thickness of the three layers is of the order of 10 nm.

For crystal structure analysis based on electron diffraction images, the image of a rhombohedral sample of the piezoelectric layer (PZT) as shown in FIG. 8A, and the image of a sample of the piezoelectric layer (PZT) [crystal plane orientation (100)]/the lower electrode film (BE) as shown in FIG. 8B were readied. Using these images, crystal structure analysis of the sample of Example 1 was conducted.

As shown in FIG. 8C, it is clear that the piezoelectric layer of Example 1, as compared with the sample images illustrated in FIGS. 8A and 8B, has a rhombohedral crystal structure in the crystal plane orientation (100).

In the crystal structure analysis based on the X-ray pole measurement pattern of the section of the sample of Example 1, especially the section of the piezoelectric layer (PZT), peaks of the (111)-section and the (110)-section were alternately detected through nearly the same rotation [$\phi$(°)], as shown in FIG. 9. This finding shows that the piezoelectric layer of Example 1 has a rhombohedral crystal structure of the crystals oriented in the crystal plane orientation (100).

A summary of the results of the foregoing crystal structure analyses shows that the piezoelectric layer of Example 1 has its crystals subjected to preferred orientation in the crystal plane orientation (100), and has a rhombohedral, single crystal structure.

In the present embodiment, as described above, the zirconium oxide layer 101, cerium oxide layer 102 and superconductor layer 103 are stacked in this order on the passage-forming substrate 10 (elastic film 50) composed of a single crystal silicon substrate having the crystals oriented in the crystal plane orientation (100). Further, the lower electrode film 60, piezoelectric layer 70 and upper electrode film 80 are stacked on the superconductor layer 103. Thus, the crystal plane orientation of the piezoelectric layer 70 can be brought into (100)-orientation.

Above the passage-forming substrate 10 on the side where the piezoelectric element 300 is provided, a sealing plate 30 having a piezoelectric element holding portion 32 is bonded, as shown in FIGS. 1 to 3. With such a space as not to hamper movements of the piezoelectric element 300 being secured in the piezoelectric element holding portion 32, the sealing plate 30 is capable of sealing the space. The piezoelectric element 300 is sealed up in the piezoelectric element holding portion 32.

In the sealing plate 30, there is provided a reservoir portion 31 constituting at least a part of a reservoir 90, which is to serve as a common liquid chamber for each pressure generating chamber 12. The reservoir portion 31 is brought into communication with the communicating portion 13 of the passage-forming substrate 10, as stated earlier, to constitute the reservoir 90 serving as the common liquid chamber for each pressure generating chamber 12.

In the region between the piezoelectric element holding portion 32 and the reservoir portion 31 of the sealing plate 30, i.e., the region corresponding to the liquid supply path 14, a connection hole 33 is provided for penetrating the sealing plate 30 in its thickness direction. External wiring 34 is provided on the surface of the sealing plate 30 on the side opposite to the piezoelectric element holding portion 32. On the external wiring 34, a driving IC 35 is mounted for driving each piezoelectric element 300. A lead electrode 85 drawn out from each piezoelectric element 300 extends to the connection hole 33, and connected to the external wiring 34, for example, by wire bonding.

A compliance plate 40, composed of a sealing film 41 and a fixing plate 42, is bonded onto the sealing plate 30. Herein, the sealing film 41 consists of a low rigidity, flexible material (for example, a 6 μm thick polyphenylene sulfide (PPS) film). The fixing plate 42 is formed from a hard material such as a metal (for example, 30 μm thick stainless steel (SUS)). In a region of the fixing plate 42 opposed to the reservoir 90, an opening portion 43 is formed by removing the fixing plate 42 completely in its thickness direction. One surface of the reservoir 90 is sealed with the flexible sealing film 41 alone.

The above-described liquid-jet head acts in the following manner: A liquid is taken in from external liquid supply means (not shown) until the liquid fills the interior of the liquid-jet head ranging from the reservoir 90 to the nozzle orifices 21. Then, according to a recording signal from a drive circuit (not shown) a voltage is applied between the lower electrode films 60 and the upper electrode films 80 corresponding to the pressure generating chambers 12 via the external wiring 34, causing flexural deformation to the elastic film 50, the zirconium oxide layer 101, the cerium oxide layer 102, the superconductor layer 103, the lower electrode film 60, and the piezoelectric layer 70. As a result, the pressure in each pressure generating chamber 12 increases, and ink droplets are ejected through the nozzle orifices 21.

Other Embodiments

Although the embodiment of the present invention has been described above, the constitution of the present invention is not limited to the above-described embodiment.

For example, a thin film type liquid-jet head, which is manufactured by applying the deposition and lithography process, has been exemplified. However, this type of liquid-jet head is not limitative. For example, the present invention can be adopted for a thick film type liquid-jet head which is formed by a method, such as adhering a green sheet.

Figure 10:
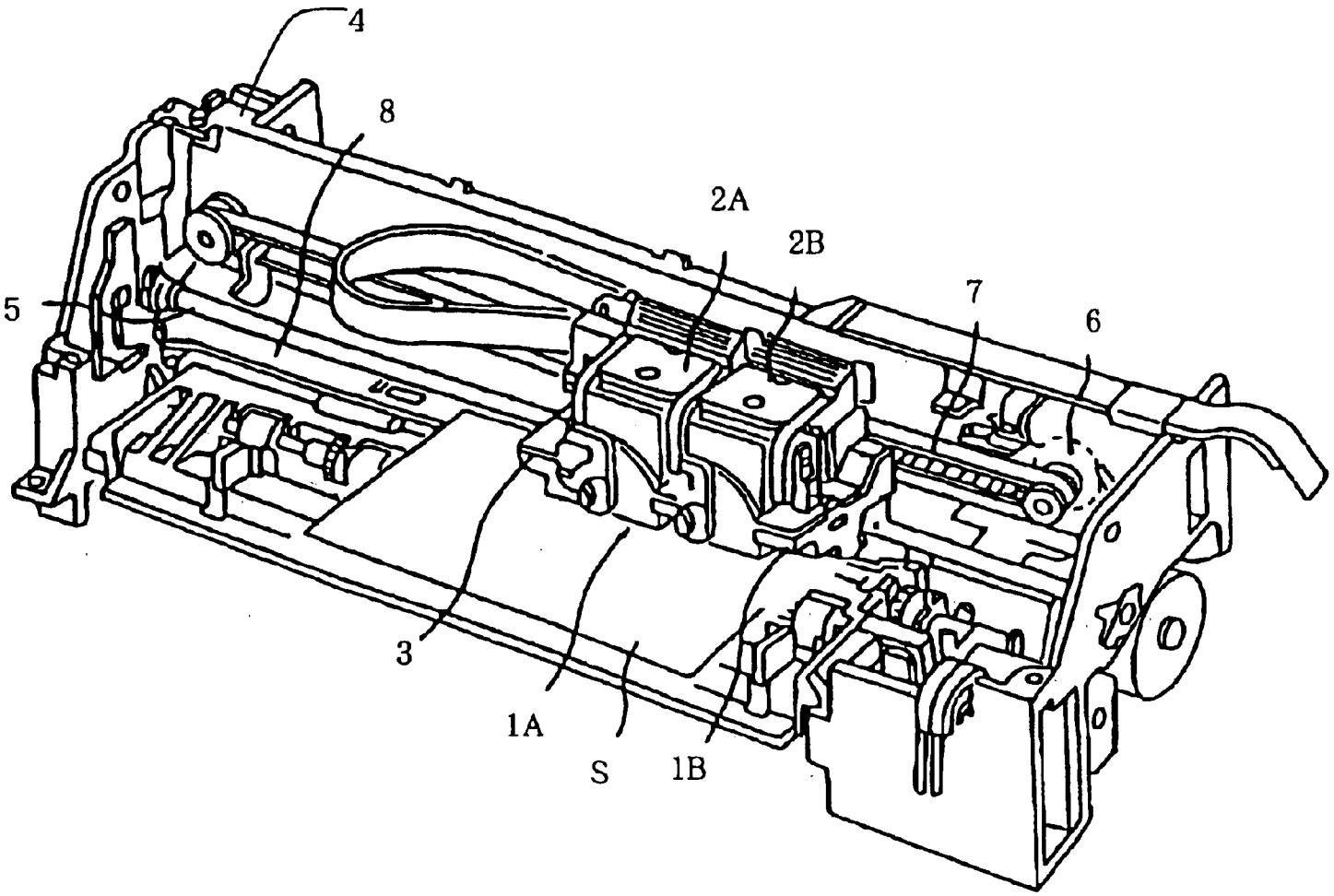
FIG. 10 is a schematic perspective view of the liquid-jet apparatus according to the embodiments of the present invention.

The liquid-jet head of the present invention constitutes a portion of a jet head unit including a liquid passage communicating with a liquid cartridge or the like, and is mounted on a liquid-jet apparatus. FIG. 10 is a schematic view showing an example of the liquid-jet apparatus.

In jet head units 1A and 1B which have the liquid-jet heads, as shown in FIG. 10, cartridges 2A and 2B constituting liquid supply means are detachably provided. A carriage 3 having the jet head units 1A and 1B mounted thereon is provided on a carriage shaft 5, which is attached to an apparatus body 4, so as to be movable in the axial direction. The jet head units 1A and 1B are adapted to eject, for example, a black ink composition and a color ink composition, respectively, as liquids.

The drive force of a drive motor 6 is transmitted to the carriage 3 via a plurality of gears (not shown) and a timing belt 7, whereby the carriage 3 bearing the jet head units 1A and 1B is moved along the carriage shaft 5. On the other hand, a platen 8 is provided on the apparatus body 4 along the carriage shaft 5. A recording sheet S, a recording medium, such as paper, fed by a paper eeding roller (not shown) is transported onto the platen 8.

In the above-mentioned embodiments, the fundamental constitution of the present invention is not limited to what has been described above. The present invention is widely directed to liquid-jet heads as a whole. For example, the invention can be applied to various recording heads, such as ink-jet recording heads for use in image recorders, e.g. printers; coloring material jet heads for use in the production of color filters such as liquid crystal displays; electrode material jet heads for use in the formation of electrodes for organic EL displays and FED (surface-emitting displays); and biological organic matter jet heads for use in the production of biochips. It goes without saying that liquid-jet apparatuses having such liquid-jet heads mounted thereon are not restricted.

As described above, the present invention can realize single-crystallization of the crystal structure of the piezoelectric layer. Furthermore, the invention can render the piezoelectric characteristics of the piezoelectric element nearly uniform, and enables a liquid to be ejected at maximum output.

What is claimed is:

1. A liquid-jet head having a passage-forming substrate in which pressure generating chambers communicating with nozzle orifices are formed; and a piezoelectric element provided on one surface of said passage-forming substrate via a vibration plate, said piezoelectric element composed of a lower electrode, a piezoelectric layer, and an upper electrode, the liquid-jet head comprising:

a zirconium oxide layer formed on the one surface of said passage-forming substrate;

a cerium oxide layer formed on said zirconium oxide layer;

a superconductor layer formed on said cerium oxide layer and composed of a yttrium-barium-copper-oxygen-based material (YBCO);

said lower electrode formed on said superconductor layer and composed of strontium ruthenate; and said piezoelectric layer formed on said lower electrode.

2. The liquid-jet head according to claim 1, wherein crystal plane orientation of said lower electrode is (100)-orientation, and crystal plane orientation of said piezoelectric layer is (100)-orientation.

3. The liquid-jet head according to claim 2, wherein a longitudinal direction of said pressure generating chamber is identical with, or at 45° to, (100)-direction included in the crystal plane orientation (100) of said piezoelectric layer.

4. The liquid-jet head according to claim 1, wherein said piezoelectric layer is composed of crystals which are rhombohedral crystals.

5. The liquid-jet head according to claim 1, wherein said piezoelectric layer is composed of lead zirconate titanate (PZT).

6. The liquid-jet head according to claim 1, wherein said piezoelectric layer is an epitaxially grown single crystal PZT thin film.

7. The liquid-jet head according to claim 1, wherein said passage-forming substrate is a single crystal silicon substrate having a crystal plane orientation (100).

8. The liquid-jet head according to claim 7, wherein said pressure generating chamber is formed in said single crystal silicon substrate by dry etching, and each layer of said piezoelectric element is formed by a deposition and lithography method.

9. A liquid-jet apparatus comprising the liquid-jet head according to any one of claims 1 to 8.

* * * * *